United States Patent [19]

Pearson

[11] 4,160,369

[45] Jul. 10, 1979

[54] COMBINED KEY HOLDER AND SECURITY DEVICE

[76] Inventor: John S. Pearson, 232 S. Pinecrest, Wichita, Kans. 67218

[21] Appl. No.: 923,065

[22] Filed: Jul. 10, 1978

[51] Int. Cl.[2] ..... A47G 29/10

[52] U.S. Cl. ..... 70/456 R; 70/459

[58] Field of Search ..... 70/456 R, 459, 456 B; 24/3 K; 273/84

[56] References Cited

U.S. PATENT DOCUMENTS

| | | | |
|---|---|---|---|
| 2,062,245 | 11/1936 | Arens | 70/456 R |
| 2,924,961 | 2/1960 | Pyper | 70/456 R |
| 4,090,380 | 5/1978 | Bianco | 70/456 R |

*Primary Examiner*—Robert L. Wolfe

*Attorney, Agent, or Firm*—Robert E. Breidenthal

[57] ABSTRACT

A hand-grippable device having hanger loops at its opposite ends for detachably hanging keys, an alarm whistle, identification tags and the like. The device also includes provision for releasably securing a selected set of keys, preferably three, thereto in such spaced positions along its length as to project outwardly from between the fingers of a gripping hand whereby they can be used to strike or be twisted with force into the person of an attacker.

12 Claims, 5 Drawing Figures

FIG. 1
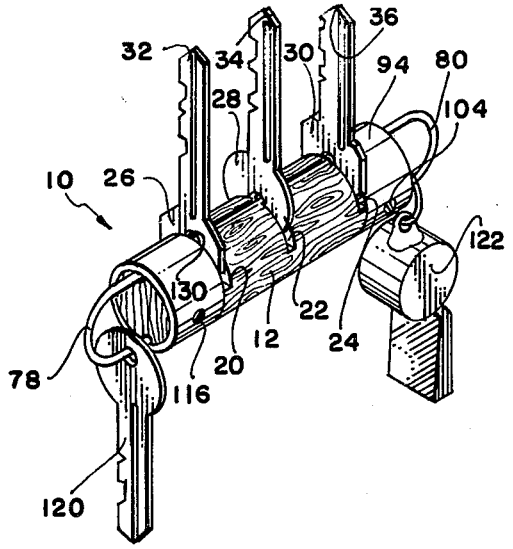
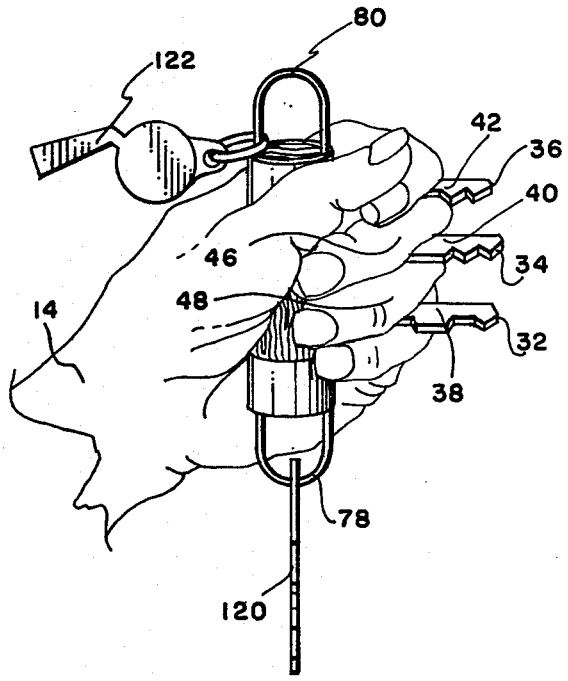
FIG. 2
FIG. 3
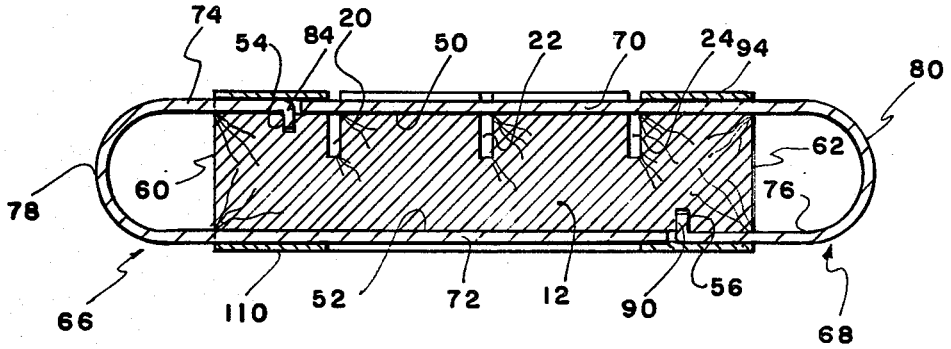

COMBINED KEY HOLDER AND SECURITY DEVICE

The present invention relates to new and useful improvements in key holders, and more particularly pertains to a key holder of such character that the same and keys held thereby can be used jointly as a defensive weapon to thwart an attacker.

Inasmuch as few persons are disposed to carry or arm themselves with legitimate defensive devices despite the high rate of crimes such as muggings, and as this is seen to be especially true in the case of females in spite of the common occurrence of rape, the paramount object of the present invention is to extend to a device of almost constantly at hand for both males and females a defense or security capability whereby such persons will ordinarily have at hand a device enabling them to defend themselves when an attack occurs. It is especially desired that such device be of such nature that it most probably will be immediately at hand, perhaps actually in the hands of the user at times when an attack has a high probability of occurrence.

Inasmuch as whenever most people are away from the security of their homes they ordinarily carry or have quick access to a collection of keys (automobile, house, office, etc.), it is, in accordance with the preceding object, an object of this invention to provide a holder for a collection of keys which has a defensive capability and which can in addition to holding keys be employed to carry an audible alarm device, such as a police-type whistle which can enable a female to signal her distress when threatened by rape.

Though not intended to possess such a capability, a consideration of prior art key holders such as those exemplified by the following listed U.S. patents does not show such key holders and the keys held thereby to be uniquely or especially well suited for use as defensive weapons:

2,208,372; Kirkpatrick, July 16, 1940;
2,493,330; Zimmerman, Jan. 3, 1950;
2,908,156; Preston, Oct. 13, 1959;
2,448,969; French, Sept. 7, 1948;
3,777,523; Holland, Dec. 11, 1973;
4,077,243; Tyson, Mar. 7, 1978;
2,400,424; Levesque, May 14, 1946.

A broad aspect of the invention involves a combined key holder and security device comprising an elongated body having transverse dimensions of a size to be readily gripped by the hand, said body having a plurality of longitudinally spaced transverse slots in one side thereof, with each of the slots having a width sufficient to accommodate reception of the head of a key therein, said slots having longitudinal spacings approximating the widths of the fingers of a body gripping hand, and means carried by the body for releasably retaining the head portion of a key in each of the slots, whereby a selected plurality of keys can be held by the body for selective individual key use while so held, and whereby the body can be gripped in the hand with the shanks of the keys extending outwardly from between the fingers of a gripping hand.

Other important objects and features of the invention will become manifest during the ensuing description of a preferred embodiment of the same, which description is given in conjunction with the accompanying drawings, wherein:

FIG. 1 is an isometric view of the key holder with keys and a whistle carried thereby;

FIG. 2 depicts the apparatus of FIG. 1 hand gripped as a defensive weapon;

FIG. 3 is a longitudinal central sectional view of the key holder shown in FIGS. 1 and 2 with the keys and whistle removed;

Figure 4:
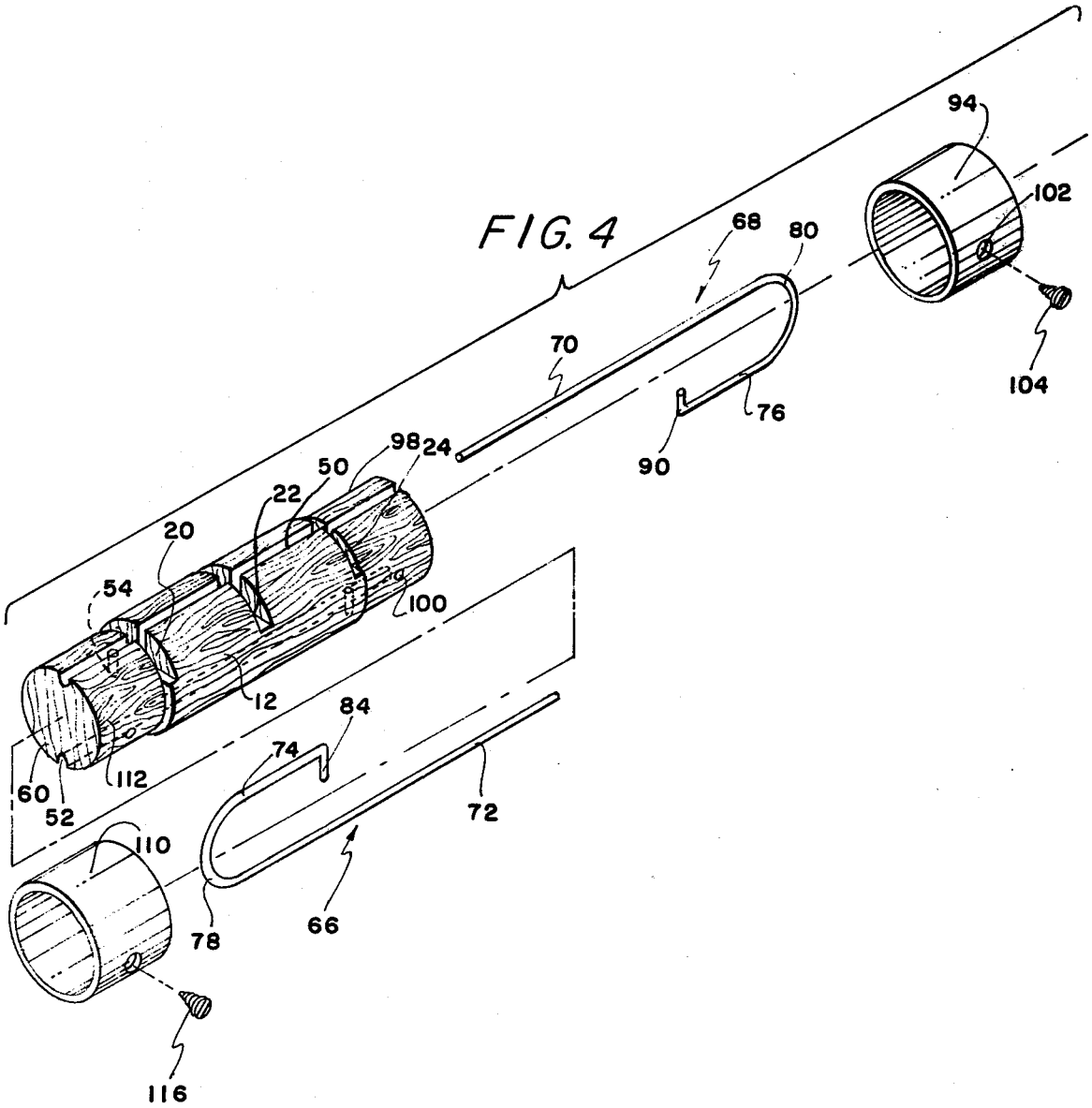
FIG. 4 is an exploded and folded isometric view of the key holder shown in FIG. 3, and, FIG. 5 is a top plan view of the body of the key holder, with the J-shaped rods and retainer bands removed.

Referring now to the drawings wherein like numerals designate like parts throughout the various views, the reference numeral 10 designates the combined key holder and security device generally.

The device 10 comprises an elongated key holder body 12 which can conveniently be fabricated of any hardwood, molded of any suitable plastic or synthetic resin, or cast and machined from a metal such as aluminum. The body 12 can be of substantially cylindrical configuration as shown in the drawings, however, if desired or deemed expedient the body 12 can have an external shape more conformable to the shape of a hand gripping the same as shown at 14 in FIG. 2 as will become manifest as the following description proceeds.

One side of the body 12 is provided with a plurality (preferably three) of longitudinally spaced transverse slots or parallel cuts such as those indicated at 20, 22 and 24. The slots 20, 22 and 24 have widths sufficient to accommodate the substantially flat head portions or bows 26, 28 and 30 of conventional paracentric type keys 32, 34 and 36 such as commonly employed in automotive ignition, home and office door locks with the bibs or fluted shanks 38, 40 and 42 of such keys extending radially outward from the body 12. Slot width of about 2½ millimeters is usually satisfactory.

The slots 20, 22 and 24 have spacings therebetween approximating the widths of fingers 46 and 48 of the hand 14 gripping the body 12, and while greater and lesser spacings can be employed between such slots, a center-to-center spacing of about 2 to 2½ centimeters has been found well suited for the use of both adult males and females. Indeed, such spacing range has been found, virtually without exception, to be suitable for a use to be explained presently in detail by essentially all persons of such ages as will customarily carry reesidence and/or automobile keys.

Figure 5:
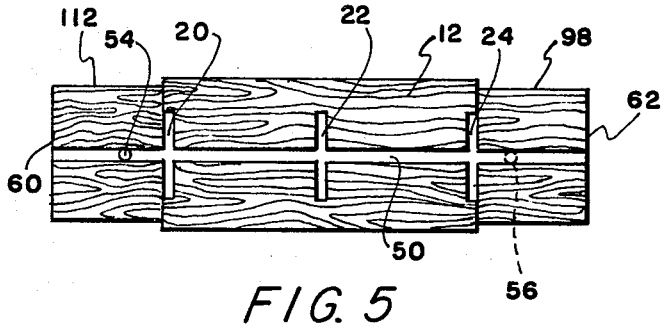

Means are provided for releasably retaining the head portions 26, 28 and 30 in the slots 20, 24 and 26, which means will additonally enable releasably attaching other objects to the body 12. Such means comprise the body 12 being provided with a pair of longitudinally extending and diametrically opposed grooves 50 and 52. The groove 50 as best shown in FIG. 5 centrally intersects the slots 20, 22 and 24. Additionally the body 12 is provided with a pair of recesses 54 and 56 which are respectively in alignment with the grooves 50 and 52, with the recess 54 being disposed intermediate the slot 20 and an end 60 of the body 12. The recess 56 is disposed longitudinally of the body 12 longitudinally intermediate the slot 24 and the other end 62 of the body 12.

A pair of identical J-shaped members designated generally at 66 and 68 are provided; such members respectively including long legs 70 and 72 and relatively short legs 74 and 76, with the long and short legs of the members 66 and 68 being joined by arcuate or bight portions 78 and 80.

When the J-shaped member 66 is in assembled relation with the body 12, the bight 78 is spaced from the body end 60, and the long and short legs 72 and 74 thereof are disposed in the grooves 52 and 50 respectively, the free end of the long leg 72 terminates short of the recess 56 while the free end of the short leg 74 is inturned as at 84 to project into the recess 54. Means presently to be described releasably retain the J-shaped member 66 in assembled relationship with the body 12.

The J-shaped members 66 and 68 are preferably metal and can be conveniently fabricated of round stainless steel or brass stock of about 2 millimeter diameter. It will be appreciated that the grooves 50 and 52 as well as the recesses 54 and 56 are dimensioned to accommodate the J-shaped members with a closely spaced and preferably snug fit.

The J-shaped member 68 is assembled with respect to the body 12 in a manner closely analogous to that described for the J-shaped member 66. The bight portion 80 is spaced from the body end 62 and the long leg 70 is disposed in the groove 50 with the free end thereof terminating in close proximity to the inturned end of the member 66 as clearly shown in FIG. 3. The short leg 76 is disposed in the groove 52 and has an inturned end 90 seated in the recess 56 in close proximity to the free end of the long leg 72 of the J-shaped member 66.

A metallic retainer band 94 which can be nickel-plated steel, embraces the long extent of the body 12 intermediate the slot 24 and the body end 62, it being noted on inspection of FIG. 3 that the band 94 additionally embraces the adjacent ends of the long and short legs of the J-shaped members 66 and 68 respectively, as well as a portion of the long leg 70 adjacent the bight portion 80. The metal retainer band 94 has a sliding fit upon those portions of the body 12 and the J-shaped members 66 and 68 embraced thereby, and can be slidingly withdrawn from its assembled position over the body end 62 and the bight portion 80. In the preferred construction the portion of the body 12 embraced by the band 94 is preferably radially reduced in size as indicated at 98 to accommodate the wall thickness of the retainer band 94. In order to retain the band 94 against inadvertent dislodgment from the assembled position shown thereof in FIG. 3, the body 12 and the band 94 are respectively provided with aligned openings 100 and 102 (see FIG. 4) and a screw 104 extends through the opening 102 and is removably threaded in the opening 100.

In an analogous fashion a metallic retainer band 110, which is identical to the band 94, removably embraces the longitudinal extent of the body 12 intermediate the slot 20 and the body end 60 with the portion of the body 12 embraced by the band 110 being radially reduced at 112 the wall thickness of the band 110. As clearly shown in FIG. 3, the band 110 embraces the adjacent end portions of the short and long legs of the J-shaped members 66 and 68, respectively. As in the case of the band 94, the band 110 is slidably removable from its assembled position, and is removably retained in such assembled position by a screw 116 extending through the band 110 and threaded into the body 12.

With the J-shaped members 66 and 68 assembled and the bands 94 and 110 secured, it will be noted that the bight portions 78 and 80 are respectively closed by the body ends 60 and 62 and can be employed to secure objects such as a key 120 and a signaling device or whistle 122. The manner in which selected objects such as the key 120 and whistle 122 can be attached and removed is thought to be readily apparent.

It will be observed that when the J-shaped member 68 is assembled on the body 12 that the long leg 70 thereof extends into and across all the slots 20, 22 and 24, the arrangement being such that the long leg or rod 70 extends through the usual opening or aperture in the key head portions or bows 26, 28 and 30, such as the opening 130 partially visible in the key head 26 in FIG. 1. In such a manner the leg or rod 70 retains the key head portions 26, 28 and 30 in the slots 20, 22 and 24. Such interlocking arrangement of the rod 70 and the keys 32, 34 and 36 is such as to enable a limited degree of freedom for the latter as the key head openings 130 are of substantially greater diameter than the rod 70. Such freedom allows a loose pivotal motion of the keys about the rod as a pivotal axis, with such pivotal motion being limited, particularly when the keys are urged toward the center of the body 12, as the rod 70 is preferably spaced from the bottom 134 of the slot 20, for example, an interval such that the head portion 26 engages the bottom 134 of the slot 20 on the key 32 being swung either way from its illustrated radially extending position. The limited pivotal movement afforded the keys 32, 34 and 36 allows a selected one of them to be used with the others swung out of the way. If any lock is situated in a physically confined location as is true in the case of many of the locks associated with ignition switches, the ignition key can be disposed in the location shown of the key 120.

The manner in which a selected set of keys 32, 34 and 36 can be retained in or selectively replaced in the slots 20, 22 and 24 during assembly of the J-shaped member is deemed obvious.

As an important use of the key holder 10 requires each of the slots 20, 22 and 24 to be equipped with a key or its equivalent, the key holder 10 may be marketed with any one or all the slots equipped with blank or simulated keys, or the user can fill any vacancy with blank or old discarded keys for which he has no continuing real use as keys.

Such additional use for the key holder 10 is as a weapon, and in such use the key holder 10 is gripped as shown in FIG. 2, that is with the keys 32, 34 and 36 extending radially from the body 12 to project between and beyond the fingers such as those indicated at 46 and 48 of the gripping hand 14.

It will be noted that when the key holder 10 is held in the defensive position illustrated in FIG. 2, the whistle 122 is disposed in a convenient position for use whereby an intended victim may signal her distress and frighten away a would-be rapist without any further action on her part being necessary. If not to be so discouraged or an assault is initiated upon a person holding the key holder 10 as shown, the free ends of the keys can be forcefully impacted against the person of the attacker. If desired, the key tips can be pressed into the person while the user effects a twisting motion about the axis of his forearm. Either of such modes of use or a combination thereof not only inflicts pain on the attacker in a degree much greater than actual physical injury so as to primarily cause the attacker to attempt escape rather than to actually disable the attacker, but quite importantly will also impart marks on the attacker's person or face greatly facilitating identification of the attacker or his apprehension.

Attention is now directed to the appended claims for an appreciation of the actual scope of the invention.

I claim:

1. A combined key holder and security device comprising an elongated body having transverse dimensions of a size to be readily gripped by the hand, said body having a plurality of longitudinally spaced transverse slots in one side thereof, with each of the slots having a width sufficient to accommodate reception of the head of a key therein, said slots having longitudinal spacings approximating the widths of the fingers of a body gripping hand, and means carried by the body for releasably retaining the head portion of a key in each of the slots, whereby a selected plurality of keys can be held by the body for selective individual key use while so held, and whereby the body can be gripped in the hand with the shanks of the keys extending outwardly from between the fingers of a gripping hand.

2. The combination of claim 1, wherein said means comprises a rod carried by the body in a position intersecting said slots, whereby the rod can be extended through the key head openings to retain the key heads in the slots.

3. The combination of claim 2, wherein said body has a longitudinally extending groove therein that intersects said slots, with said rod being disposed in said groove.

4. The combination of claim 1 and a plurality of generally key-shaped members each comprising a generally flat head portion and an integral elongated shank, with said head portion having an opening therethrough, said members having their head portions projecting into the slots, said means including an elongated rod carried by the body for lengthwise movement relative thereto between first and second positions respectively clear of and intersecting all said slots, means for releasably securing said rod in its second position, and said rod extending through the openings of all the key head portions when in its second position.

5. The combination of claim 4, wherein said rod has an open loop at one end thereof constituting a key and whistle hanger, said loop being respectively in and out of engagement with the body when the rod is in its first and second positions in an arrangement such that articles hanging on the loop are secured against removal therefrom by the body when the rod is in its second position.

6. The combination of claim 5, wherein a whistle is carried by said hanger.

7. The combination of claim 4, wherein said means for releasably retaining the rod in its second position comprises said rod having an end portion having an extent transverse to the extent of the body, said body having a recess removably receiving said rod end portion when the rod is in its second position, and a detachably secured band embracing the body and said rod end portion to retain the rod end portion in said recess.

8. The combination of claim 1, wherein said means comprises said body having a longitudinal groove in said one side thereof intersecting said slots, an elongated rod removably received in the groove in a position traversing the slots in an arrangement adapted to extend through the openings in the key head portions, and means for releasably retaining the rod in the groove in its position traversing the slots, said last means including a pair of retainer bands detachably secured to the body to embrace the rod and the body adjacent opposite ends of the latter.

9. The combination of claim 8, wherein said last means includes said rod having an inturned end portion with the body having a recess removably receiving such inturned end portion, with one of said bands embracing such inturned end portion of the rod to retain the latter in the recess.

10. The combination of claim 1, wherein said means comprises said body having an elongated groove intersecting all the slots, said body having a recess therein adjacent one end thereof at a position diametrically opposed to the groove, a generally J-shaped elongated element including a long and a relatively short leg connected thereto by a bight portion, said short leg having an inturned end portion, said long leg being removably seated in the groove with the inturned end portion of the short leg being removably received in the recess in an arrangement such that the bight portion is spaced from said one end of the body and is adapted for the hanging of apertured objects thereon, and a pair of retainer bands detachably secured to the body adjacent said one end and its opposite end to embrace the body and the free ends of the legs.

11. The combination of claim 10, inclusive of a second J-shaped element constituted of a long leg and a short leg connected by a bight portion, with short leg of the second element having an inturned end portion, said body having a second longitudinal groove, said body having a second recess adjacent said opposite end thereof at a position diametrically opposed to the second groove, said long leg of the second element being removably received in the second groove and the inturned end portion of the second element being removably received in the second recess in an arrangement such that the bight portion of the second element is spaced from said opposite end of the body and adapted for the hanging of apertured objects thereon, with said second element being releasably retained in position by said bands embracing the free ends of the legs of the second element.

12. The combination of claim 11, wherein the grooves are diametrically opposed to each other, and wherein the J-shaped elements are identical to each other.

* * * * *